US005465439A

United States Patent [19]

Chien

[11] Patent Number: 5,465,439

[45] Date of Patent: Nov. 14, 1995

[54] DEVICE FOR RETAINING A PLAYPEN IN AN EXTENDED POSITION

[75] Inventor: Jui-Lung Chien, Taichung, Taiwan

[73] Assignee: Jina Manufacturer Thai Co., Ltd., Bangkok, THX

[21] Appl. No.: 352,228

[22] Filed: Dec. 8, 1994

[51] Int. Cl.[6] ..... A47D 7/00

[52] U.S. Cl. ..... 5/99.1

[58] Field of Search ..... 5/93.1, 98.1, 99.1

[56] References Cited

U.S. PATENT DOCUMENTS

| | | | |
|---|---|---|---|
| 5,339,470 | 8/1994 | Shamie | 5/98.1 |
| 5,353,451 | 10/1994 | Hsiung | 5/98.1 |

*Primary Examiner*—Michael J. Milano
*Attorney, Agent, or Firm*—Sixbey, Friedman, Leedom & Ferguson

[57] ABSTRACT

A playpen floor structure includes a joint, a plurality of tubes pivotably linked to the joint and a device for retaining the playpen floor structure in an extended position. The device includes a housing rotatably mounted on the joint between a first position and a second position, two blades projecting radially from the housing in opposite directions. Each of the blades includes a free end portion projecting downwardly therefrom. The free end portion of each of the blades is formed as a hook. Two of the tubes are engageable with the hooks in the first position. The two of the tubes are disengageable from the hooks in the second position. A cylinder projects downwardly from the housing. A helical spring is mounted on the cylinder. The helical spring includes a first tip secured to the housing and a second tip secured to the joint so that the housing is retainable in the first position by the spring. A recess is defined in the housing, and a recess is defined in an ear projecting upwardly from the joint. The first tip of the spring is receivable in the recess defined in the housing while the second tip of the spring is receivable in the recess defined in the ear. Two limits project radially from the joint in opposite directions for restraining the hooks when the housing is moved to the second position.

8 Claims, 4 Drawing Sheets

DEVICE FOR RETAINING A PLAYPEN IN AN EXTENDED POSITION

FIELD OF THE INVENTION

This invention relates to a device for retaining a playpen in an extended position.

RELATED PRIOR ART

U.S. patent application Ser. No. 08/294,260 teaches a playpen floor structure including a central joint and a plurality of tubes pivotably linked to the central joint. The playpen floor structure provides strong support to a child enclosed in the playpen. However, there is not device for preventing unintentional folding of the playpen floor structure. The child may be hurt as a result of the unintentional folding of the playpen floor structure.

SUMMARY OF THE INVENTION

It is the primary objective of this invention to provide a playpen floor structure including a joint, a plurality of tubes pivotably linked to the joint and a device for retaining the playpen floor structure in an extended position. The device includes a housing rotatably mounted on the joint between a first position and a second position, two blades projecting radially from the housing in opposite directions. Each of the blades includes a free end portion projecting downwardly therefrom. The free end portion of each of the blades is formed as a hook. Two of the tubes are engageable with the hooks in the first position. The two of the tubes are disengageable from the hooks in the second position.

In another aspect, a screw is used for retaining the housing on the joint.

In another aspect, a spring includes a first tip secured to the housing and a second tip secured to the joint so that the housing is retainable in the first position by means of the spring.

In another aspect, a cylinder projects downwardly from the housing. The spring is a helical spring mounted on the cylinder.

In another aspect, a recess is defined in the housing, and a recess is defined in an ear projecting upwardly from the joint. The first tip of the spring is receivable in the recess defined in the housing while the second tip of the spring is receivable in the recess defined in the ear.

In another aspect, two limits project radially from the joint in opposite directions for restraining the hooks when the housing is moved to the second position.

DETAILED DESCRIPTION OF THE DRAWINGS

Figure 1:
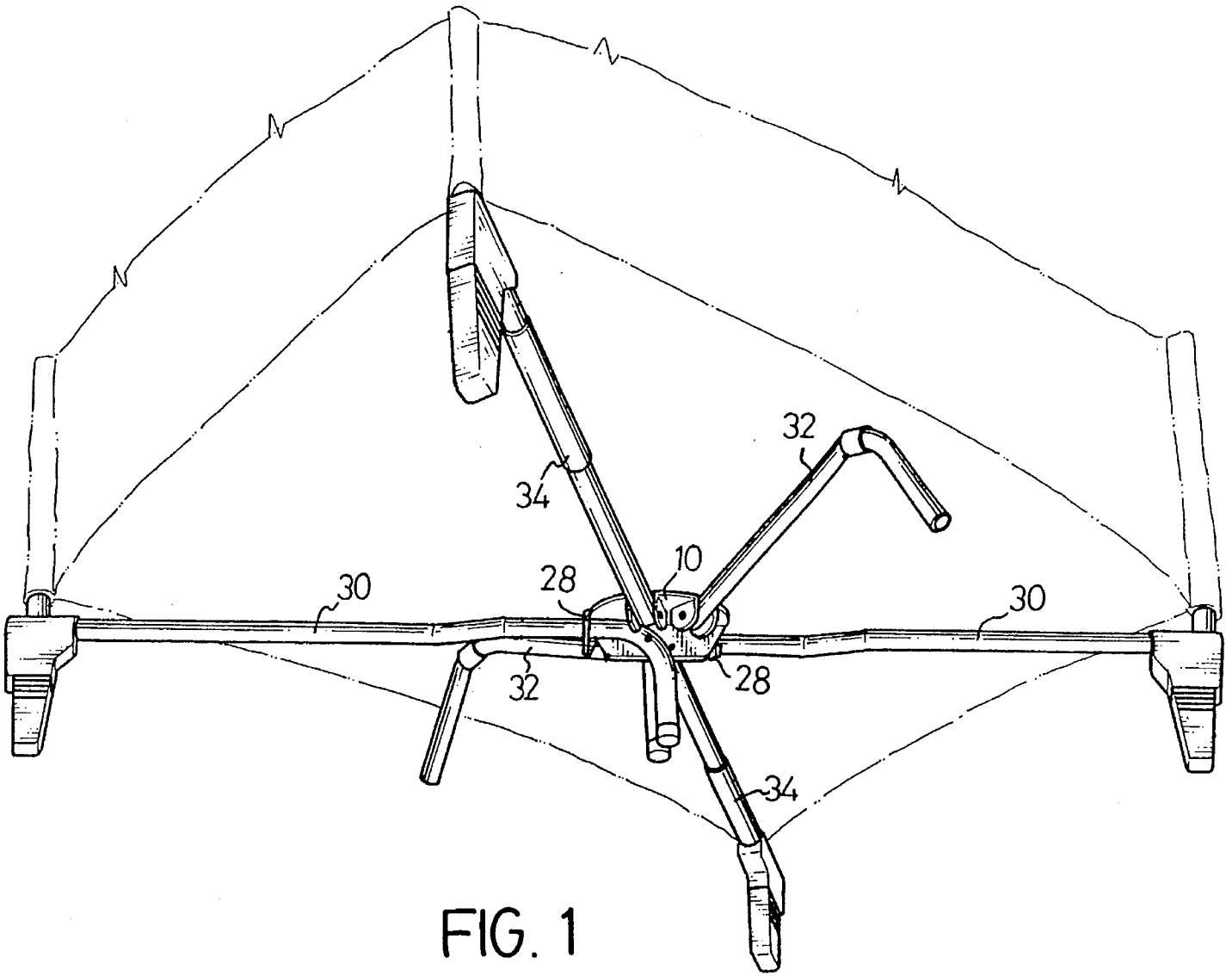
FIG. 1 is a partial view of a playpen using a device for retaining the playpen in an extended position according to this invention.

FIG. 1 shows a playpen floor structure including a joint 10 formed as a disk. Two tubes 30, two tubes 32 and two tubes 34 are pivotably linked to the joint 10.

Figure 2:
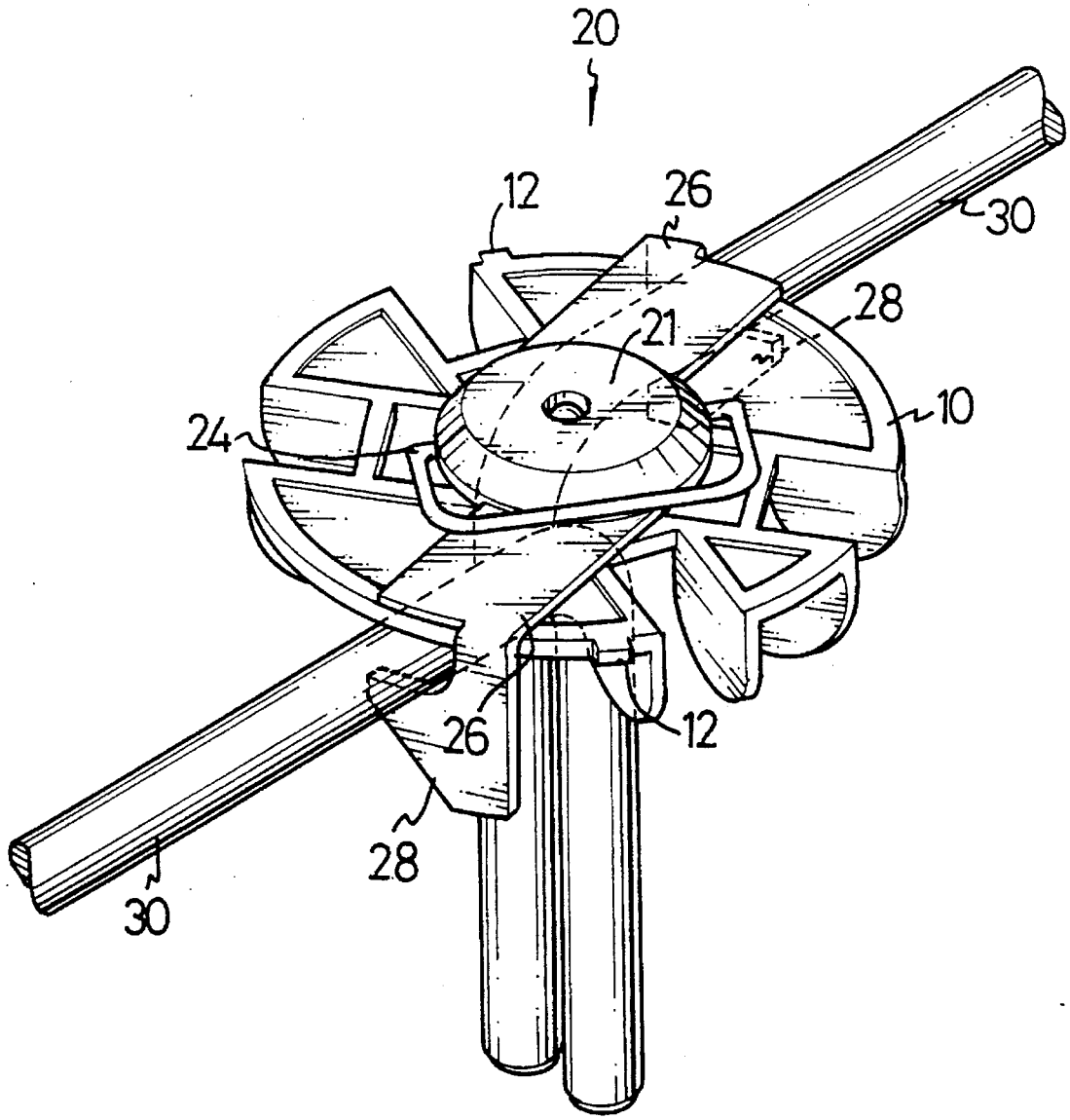
FIG. 2 is an enlarged view of the preferred embodiment of the device for retaining a playpen in an extended position according to this invention.
Figure 3:
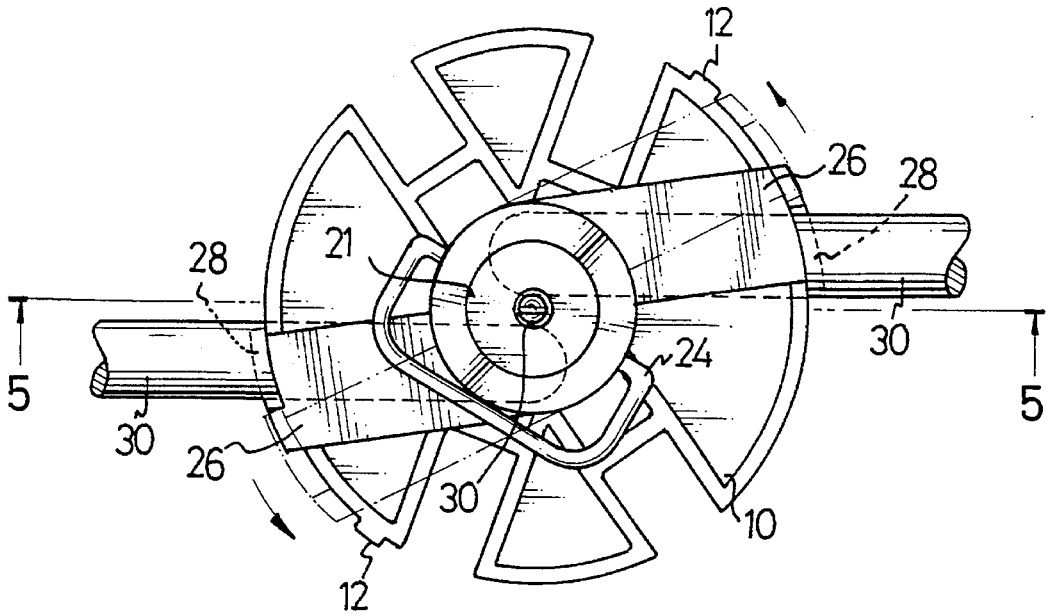
FIG. 3 is a top view of the device as shown in FIG. 2.
Figure 4:
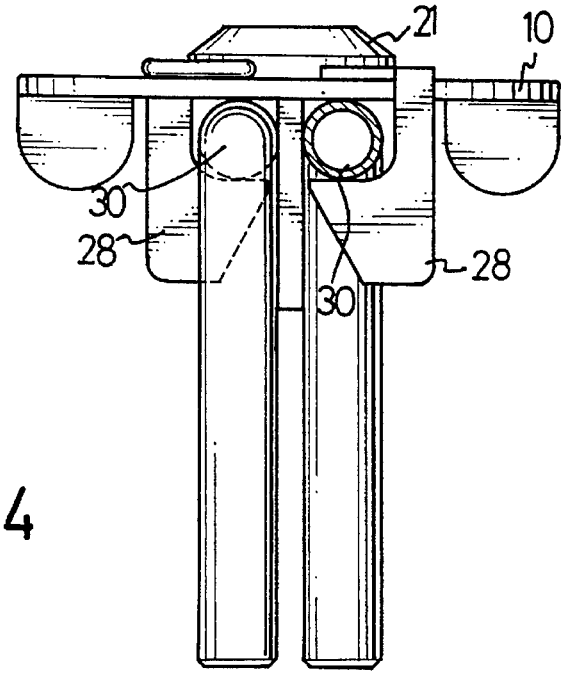
FIG. 4 is a side view of the device as shown in FIG. 3.

FIGS. 2–4 show the joint 10, two tubes 30 and a device 20 for retaining the tubes 30 in an extended position. Two limits 12 project radially from the joint 10 in opposite directions. An ear 14 projects upwardly from the joint 10. The device 20 includes a housing 21 and two blades 26 projecting radially from the housing 21 in opposite directions. Each of the blades 26 includes a free end portion projecting therefrom. The free end portion of each of the blades 26 is formed as a hook 28.

The housing 21, the blades 26 and the hooks 28 are pivotable between a first position and a second position. The housing 21, the blades 26 and the hooks 28 are retainable in the first position by means of a helical spring 25 (see FIG. 5). The housing 21, the blades 26 and the hooks 28 are movable to the second position so that the hooks 28 are restrained by means of the limits 12. In the first position, the tubes 30 are restrained by means of the hooks 28. In the second position, the tubes 30 are disengaged from the hooks 28.

Two opposite apertures (not numbered) are defined in the housing 21. A handle 24 includes two end portions (not numbered) projecting towards each other. Each of the end portions of the handle 24 is insertable into each of the apertures defined in the housing 21. The handle 24 is thus attached to the housing 21 so that the device is pivotable easily by means of operating the handle 24.

Figure 5:
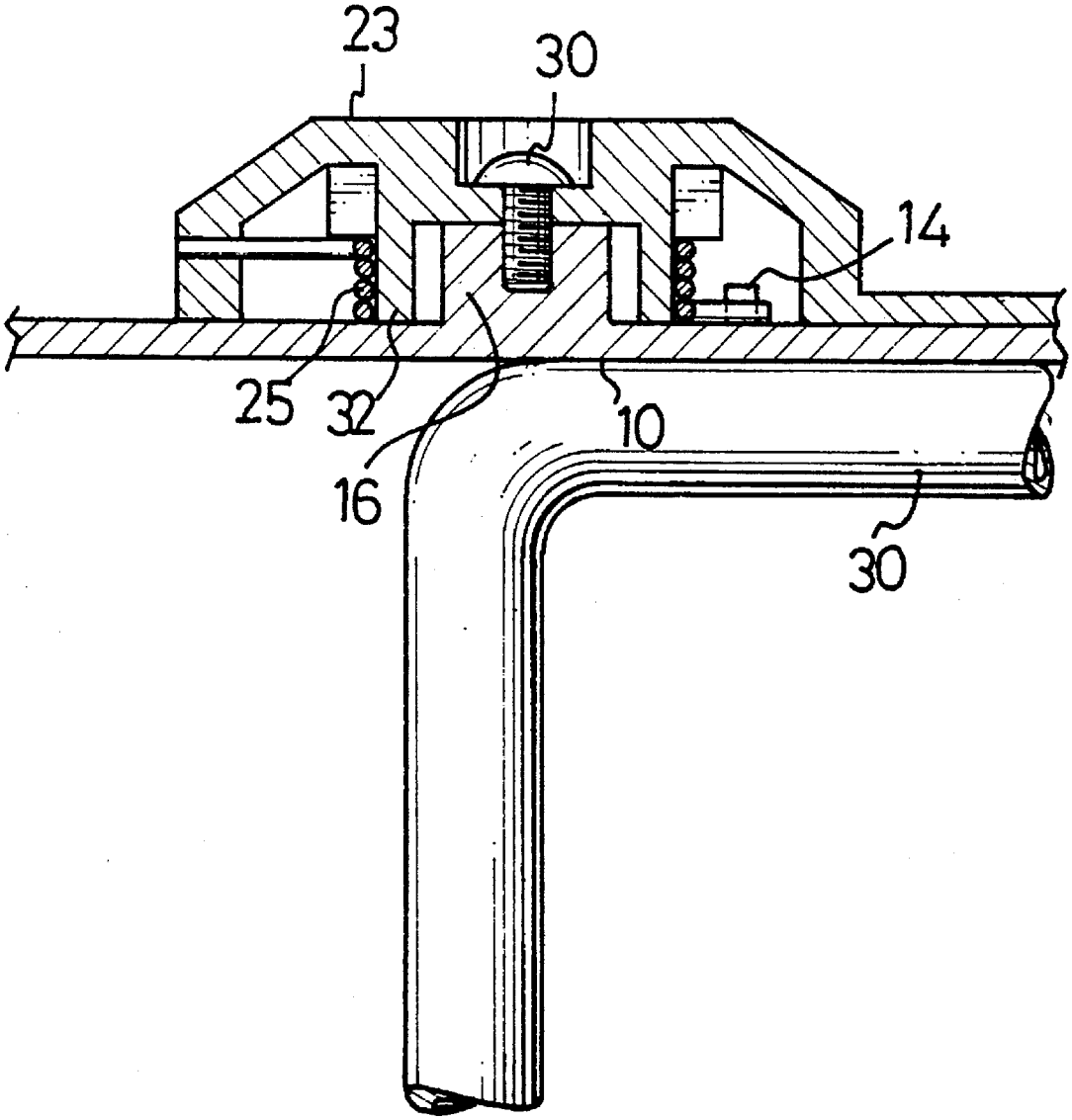
FIG. 5 is a cross-sectional view taken in a line 5—5 in FIG. 3.

Referring to FIG. 5, a stem 16 projects upwardly from the joint 10. A central aperture (not numbered) is defined in the housing 21. A screw 30 is insertable through the central aperture defined in the housing 21. The housing 21 is rotatable relative to the screw 30 as the diameter of the central aperture defined in the housing 21 is greater than that of the screw 30. The screw 30 is secured to the joint 10 so that the housing 21 is retained on the joint 10.

A cylinder 32 projects downwardly from the housing 21. The helical spring 25 is mounted on the cylinder 32. The helical spring 25 includes a first end portion and a second end portion. The first end portion of the helical spring 25 is receivable in a recess defined in the housing 21 while the second end portion of the helical spring 21 is receivable in a recess defined in the ear 14. The housing 21, the blades 26 and the hooks 28 are retainable in the first position by means of the helical spring 25.

Although a cylinder 32 is included in the preferred embodiment, the cylinder 32 can be deleted. In such a case, the helical spring 25 is mounted on the stem 16.

Although a helical spring 25 is used in the preferred embodiment, the helical spring 25 can be replaced with an appropriate spring including a first tip secured to the housing 21 and a second tip secured to the joint 10. The spring may be a tension spring or a compression spring.

What I claim as my invention is:

1. A playpen floor structure comprising a joint, a plurality of tubes pivotably linked to the joint and a device for retaining the playpen floor structure in an extended position, the improvement comprising that the device includes a housing rotatably mounted on the joint between a first position and a second position, two blades projecting radially from the housing in opposite directions wherein each of the blades includes a free end portion projecting downwardly therefrom wherein the free end portion of each of the blades is formed as a hook, wherein two of the tubes are engageable with the hooks in the first position, wherein the two of the tubes are disengageable from the hooks in the second position.

2. A playpen floor structure according to claim 1 including a screw for retaining the housing on the joint.

3. A playpen floor structure according to claim 1 including a spring including a first tip secured to the housing and a second tip secured to the joint so that the housing is retainable in the first position by means of the spring.

4. A playpen floor structure according to claim 3 including a cylinder projecting downwardly from the housing, wherein the spring is a helical spring mounted on the cylinder.

5. A playpen floor structure according to claim 4 including a recess defined in the housing and a recess defined in an ear projecting upwardly from the joint, so that the first tip of the spring is receivable in the recess defined in the housing while the second tip of the spring is receivable in the recess defined in the ear.

6. A playpen floor structure according to claim 1 including two limits projecting radially from the joint in opposite directions for restraining the hooks when the housing is moved to the second position.

7. A playpen floor structure according to claim 1 including a handle attached to the housing.

8. A playpen floor structure according to claim 7 wherein the housing defined two opposite apertures, wherein the handle includes two tips projecting towards each other, so that the tips of the handle are insertable into the opposite apertures defined in the housing.

* * * * *